US006450537B2

(12) United States Patent
Norris

(10) Patent No.: US 6,450,537 B2
(45) Date of Patent: Sep. 17, 2002

(54) SELF-SERVICE POSTAGE STAMP ASSEMBLAGE

(75) Inventor: Philip R. Norris, North Reading, MA (US)

(73) Assignee: Polaroid Corporation, Cambridge, MA (US)

( * ) Notice: Subject to any disclaimer, the term of this patent is extended or adjusted under 35 U.S.C. 154(b) by 0 days.

(21) Appl. No.: 09/766,339

(22) Filed: Jan. 19, 2001

Related U.S. Application Data

(60) Provisional application No. 60/177,877, filed on Jan. 24, 2000.

(51) Int. Cl.[7] ..... G09F 3/00

(52) U.S. Cl. ..... 283/71; 40/638; 229/68.1; 283/81

(58) Field of Search ..... 283/71, 81; 40/638, 40/630; 229/68.1

(56) References Cited

U.S. PATENT DOCUMENTS

| | | | | | |
|---|---|---|---|---|---|
| 3,685,187 | A | * | 8/1972 | Hillmer | 40/159 |
| 3,830,422 | A | * | 8/1974 | Dunn | 229/71 |
| 4,083,137 | A | * | 4/1978 | Rozmanith | 40/158 R |
| 4,653,775 | A | | 3/1987 | Raphael et al. | 283/108 |
| 4,889,748 | A | * | 12/1989 | Dudley | 428/11 |
| 5,040,671 | A | * | 8/1991 | Hager | 206/39 |
| 5,423,573 | A | | 6/1995 | Passillé | 283/71 |
| 5,461,187 | A | * | 10/1995 | Dudley | 84/94.2 |
| 5,503,436 | A | * | 4/1996 | Alpaugh et al. | 283/101 |
| 5,669,165 | A | * | 9/1997 | Santorsola | 40/124.191 |
| 5,685,570 | A | * | 11/1997 | Gray et al. | 283/71 |
| 5,836,617 | A | | 11/1998 | Beaudoin et al. | 283/67 |
| 5,873,605 | A | | 2/1999 | Kaplan | 283/71 |
| 5,902,439 | A | * | 5/1999 | Pike et al. | 156/252 |
| 5,943,432 | A | * | 8/1999 | Gilmore et al. | 382/101 |
| 5,944,461 | A | * | 8/1999 | Kanbar | 408/705 |
| 6,242,552 | B1 | * | 6/2001 | Su | 526/318.43 |
| 6,293,037 | B1 | * | 9/2001 | Spada et al. | 40/638 |

FOREIGN PATENT DOCUMENTS

EP 0 893 787 A2 1/1999

* cited by examiner

*Primary Examiner*—A. L. Wellington
*Assistant Examiner*—Monica Carter

(57) ABSTRACT

A postage stamp assemblage wherein an indicia bearing element containing a photographic film unit is covered by an overlay sheet containing a transparent zone, allowing the photographic film unit to be visible. The postage stamp assemblage contains machine readable indicia and postage indicia.

5 Claims, 3 Drawing Sheets

SELF-SERVICE POSTAGE STAMP ASSEMBLAGE

REFERENCE TO RELATED APPLICATIONS

This application claims the benefit under 35 USC §120 of prior provisional patent application serial No. 60/177,877, filed Jan. 24, 2000.

BACKGROUND OF THE INVENTION

The present invention relates to postage stamp assemblages and, preferably, to an improved postage stamp assemblage incorporating a photograph.

The U.S. Postal Service has implemented many changes allowing users to meter postage on mail and print postage in the form of labels that are affixed to mail, wherein the labels are compatible with postal system equipment. Another known postage approach is practiced in Australia which allows postal patrons to send photographs to the postal authority for creating a composite postage assemblage comprising a conventional stamp portion and an image portion that has printed thereon the photograph submitted by the postal patron. Fully encompassing and laminating photographs in a plastic pouch is well-known in the identification card art; such as is evidenced by the several U.S. Patents (e.g., U.S. Pat. Nos. 4,992,353; and 4,653,775) assigned to Polaroid Corporation.

Custom-printed postage labels are well known in the art. For example, U.S. Pat. No. 5,836,617 issued to Beaudoin, et al teaches a pressure sensitive adhesive label having postage indicia used to produce mailing pieces at high speeds.

U.S. Pat. No. 5,423,573 issued to de Passile discloses a composite stamp having two parts used in combination to provide a finished stamp. One part bears postage-related information and a second part bears decorative design(s), allowing the user to customize the postage stamp.

U.S. Pat. No. 5,873,605 issued to Kaplan teaches a personalized postage stamp. Kaplan claims a method for producing a postage stamp bearing a photograph. The Kaplan method requires the photograph to be taken at a vending station, thus limiting the types of images that can be used in the stamp.

None of these references disclose a user-definable stamp capable of using a user-supplied photograph as a basis for a postage stamp assemblage. It is desirable to enhance the self-service capabilities of a postal system by providing individuals with a system to generate their own postage assemblage especially by using photographs of their making as an integral component of the assemblage.

SUMMARY OF THE INVENTION

In accordance with the present invention, provision is made for a postage stamp assemblage that comprises an indicia bearing element and a supporting member joinable together for forming a postage stamp assemblage by a postal patron that is affixable to mail and which is otherwise compatible with equipment in the postal system.

In an illustrated embodiment, the indicia bearing element is a photographic film image and the supporting member is a transparent overlay which encompasses and is laminated to the film image, wherein the overlay is itself adhesively securable to mail.

It is an object of the present invention to provide a postage stamp assemblage of the foregoing type which can be made by a postal patron to include an image bearing element and which that is compatible with postal system equipment.

It is an object of the present invention to provide a postage stamp assemblage of the foregoing type that includes a photographic film unit, such as of the self-developing type.

It is an object of the present invention to provide a postage stamp assemblage of the foregoing type that allows any photographic film unit of a predetermined size to be laminated to an overlay which is affixable to mail for use in the postal service.

It is an object of the present invention to provide a postage stamp assemblage of the foregoing type that makes provision for a self-service system with the capability of allowing artistic freedom to postal patrons using a variety of images, and yet satisfy the requirements of the postal system in terms of handling such postage.

It is an object of the present invention to provide a postage stamp assemblage kit that allows the formation of a postage stamp assemblage comprising a photographic film unit.

It is an object of the present invention to provide a low-cost yet reliable system for forming postage stamp assemblages acceptable by a postal authority.

These and other objects and scope of the present will become apparent after reading the following detailed description when taken in conjunction with the accompanying drawings in which like reference numerals indicate like structure throughout the several views.

DETAILED DESCRIPTION

Figure 1:
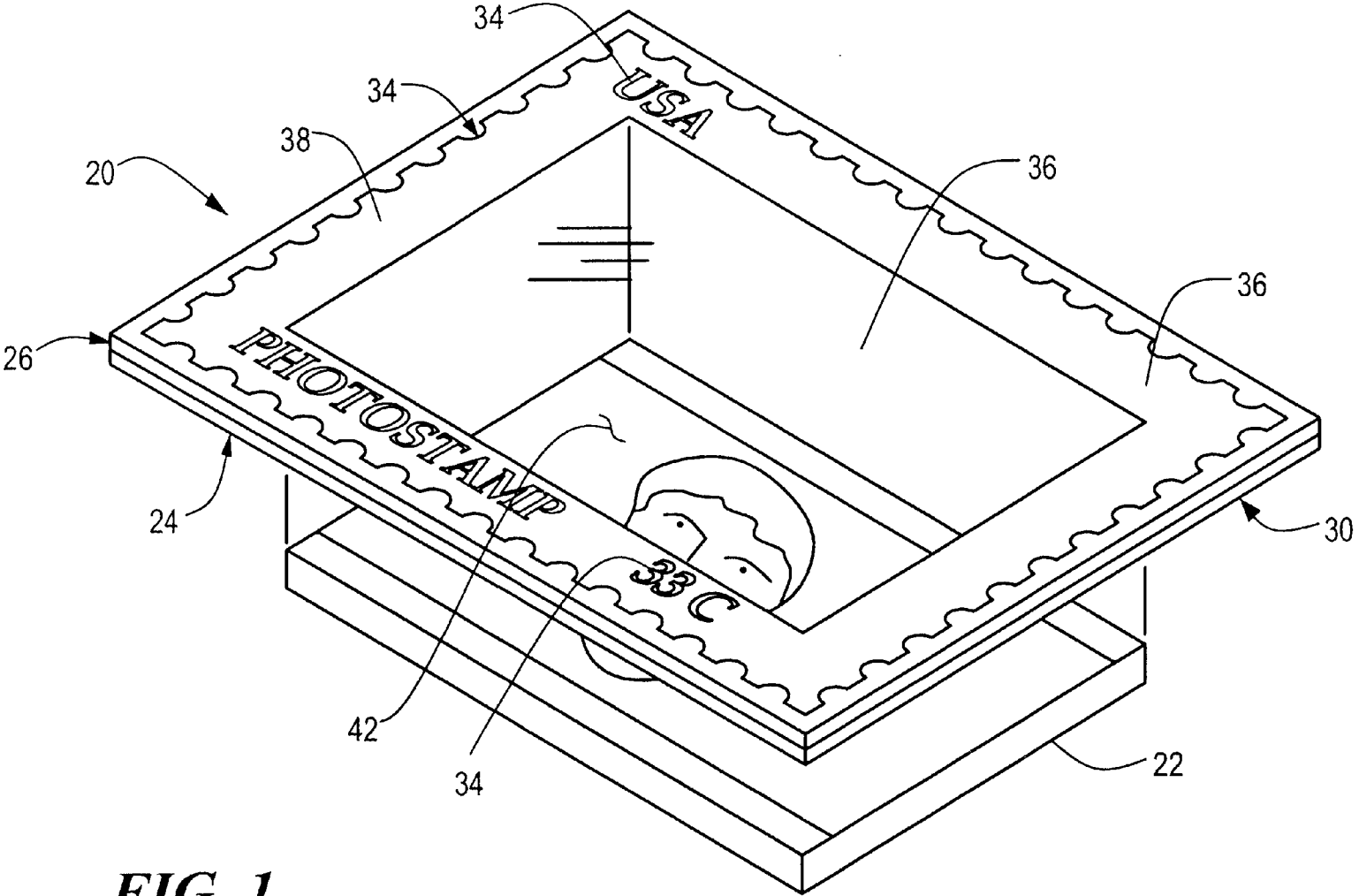
FIG. 1 is an exploded perspective of one preferred embodiment of a postage stamp assemblage of the present invention.

One preferred embodiment of a postage stamp assemblage 20 of the present invention is illustrated in FIG. 1, wherein there is depicted a photographic film unit 22 and in juxtaposition thereto a larger coextensive plastic laminar overlay sheet 24 having a generally rectangular configuration. Preferably, both the film unit 22 and the overlay sheet 24 are joined or laminated together by a postal patron, in a manner to be described, through the use of adhesive and pressure.

The laminar overlay 24 is comprised, preferably, of a thin, transparent, and flexible sheet 26 having a generally rectangular configuration that overlies the photographic film unit 22. In this embodiment, the film unit 22 is, preferably, of the self-developing type that is commercially available from Polaroid Corporation, Cambridge, Mass.; such as the type described in U.S. Pat. No. 5,888,693. The sheet 26 is also, preferably, made from a transparent material; although translucent or opaque materials are envisioned. If transparent, the sheet can be constructed of PVA (polyvinyl acetate), Mylar™, or other suitable materials having similar physical and chemical properties. The sheet 26, preferably, has at least a major portion of its bottom surface coated with an adhesive which in a preferred embodiment is a pressure-sensitive adhesive layer 30. The adhesive may comprise any suitable adhesive material and may be of any thickness consistent with the use of the invention for postal purposes. Ideally, the pressure-sensitive adhesive would be transparent and not adversely affected by chemicals of the film unit or postal equipment, yet be safe to handle. Examples of such adhesives are described in several patents assigned to Polaroid Corporation and which are well known in the manufacture of ID cards. Such pressure-sensitive adhesives are commercially available. For instance, the assemblage 20 can be applied to surfaces with the mere application of pressure. The foregoing are to be considered as illustrative and is not to be construed limiting in any way.

The sheet 26 has its upper surface 32 formed to be ink accepting so as to allow for postal printing thereon, such as cancellations. For instance, the upper surface 32 is to be printed with postage indicia 34, such as postage amount, country, and zip code that are to be read by a postal patron. Other kinds of indicia 34 such as serrations can be printed. Also, machine readable indicia 36 of the type usable for automatic mail sorting purposes is provided. The machine readable indicia 36 can, for instance, comprise ultraviolet (UV) phosphor as is known. The human readable indicia 34 can, preferably, be printed along label portions 38 of the upper surface 32 of the overlay 24, such as adjacent the periphery of the overlay 20 and outside a transparent zone 42 that is sized to accommodate and protect the film unit 22. In this manner, the human readable indicia does not interfere with viewing the image (not shown) of the photographic film unit through a transparent film zone 42.

Figure 2:
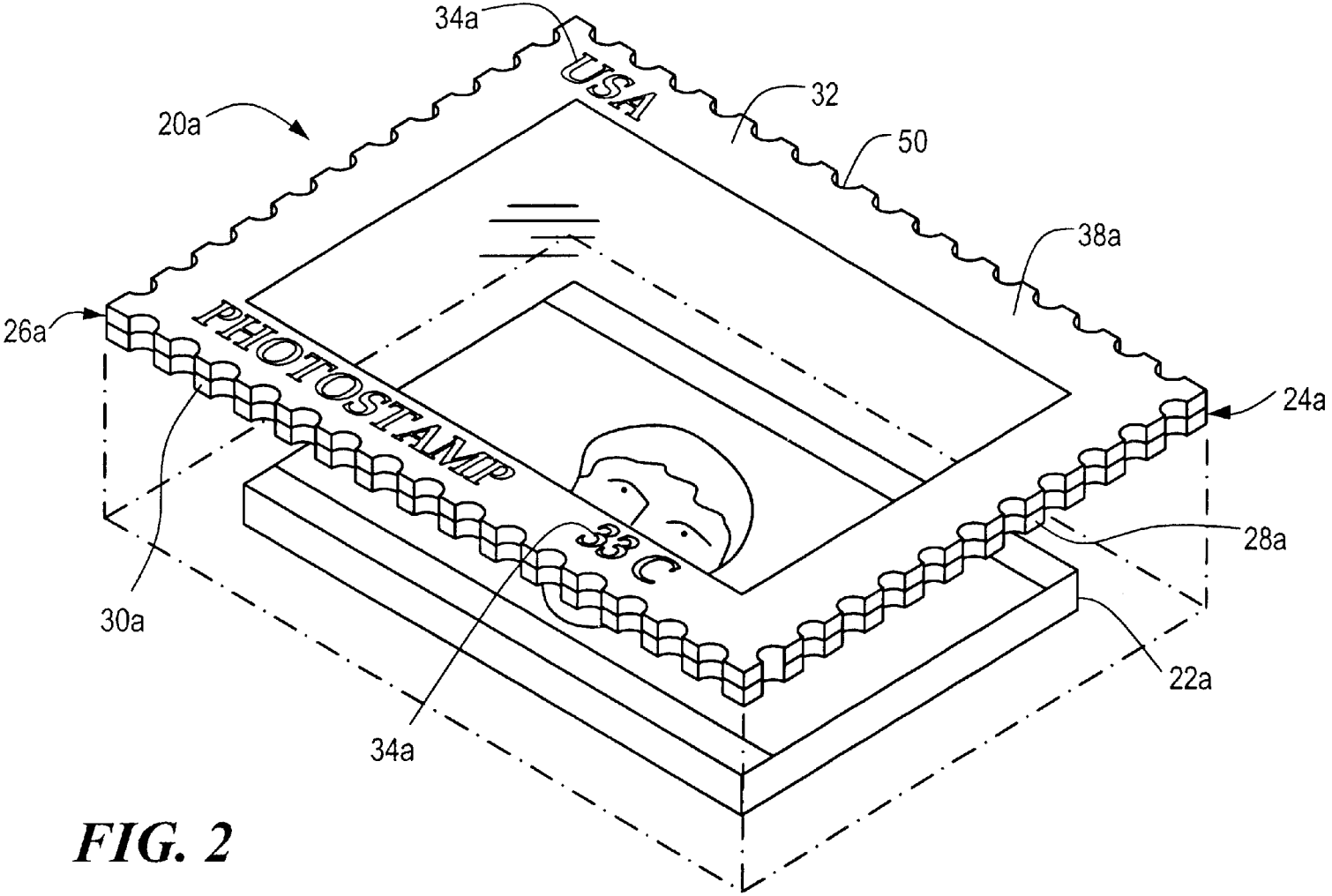
FIG. 2 is an exploded perspective of another preferred embodiment of a postage stamp assemblage of the present invention; and, FIG. 3 is an exploded perspective of still another preferred embodiment of a postage stamp assemblage of the present invention.

FIG. 2 illustrates another preferred embodiment of a postage assemblage 20*a* that is made in accordance with the present invention. Structure of this embodiment that is similar to the other embodiment will be represented by similar reference numerals with however the addition of the suffix "a". Essentially in this embodiment, the label portions 38*a* can be printed and the outer periphery of the overlay 24*a* includes die cut serrations 50.

Figure 3:
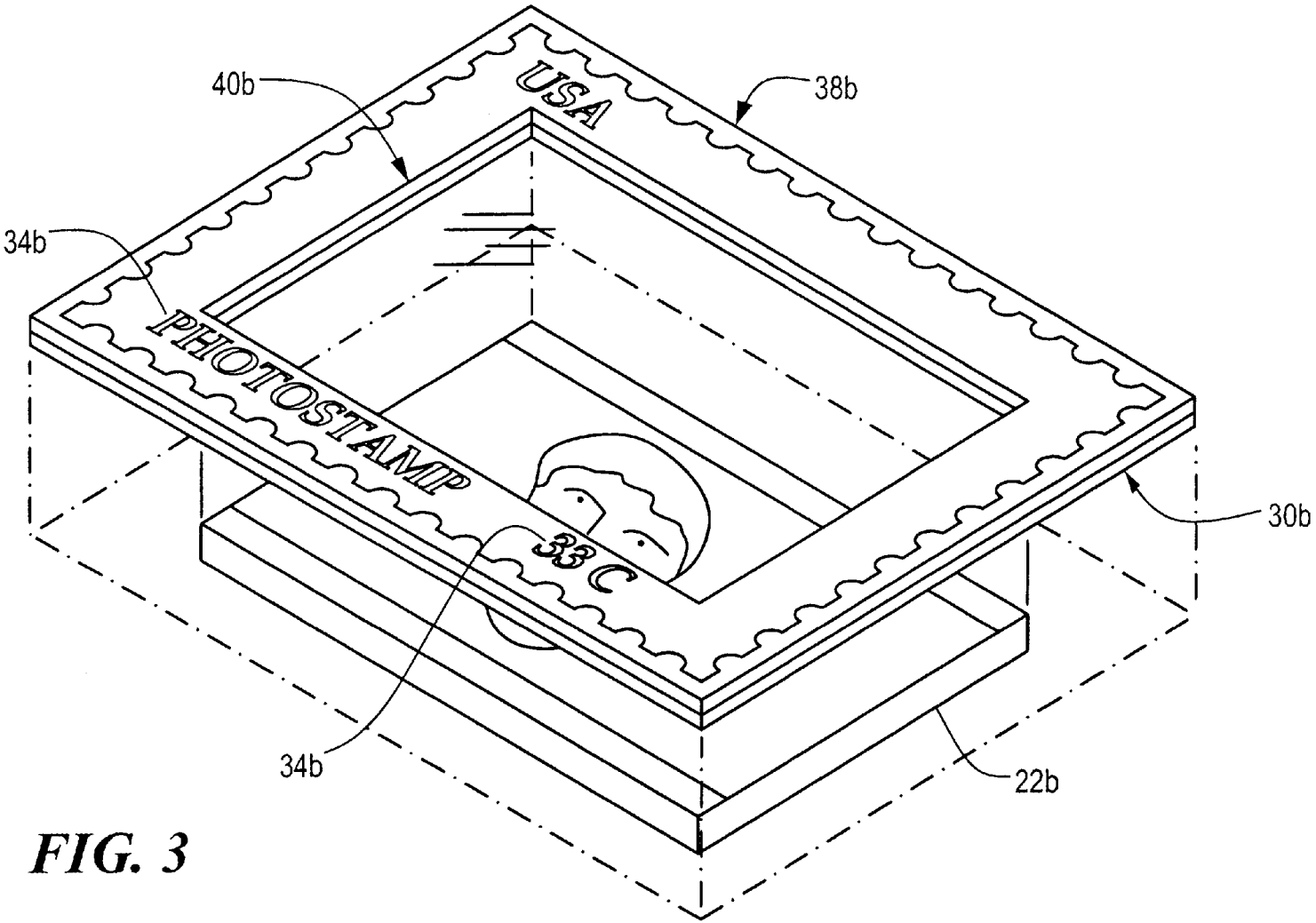

FIG. 3 illustrates another preferred embodiment of the present invention. This embodiment is similar to FIG. 1 and corresponding structure will be represented with the same reference numeral with however the addition of the suffix "b". In this embodiment the transparent zone 40*b* is die cut and adapted to be in registration with the image bearing portion of the film unit 22*b*. The film unit is to be larger than the zone, but less than the overlay.

It will be appreciated that the overlays could be sold in sheets by a postal authority for use in connection with a kit employing a film of the type noted as well as a camera using such film.

From the foregoing it will be appreciated that the principles of the present invention may be practiced and embodied in several forms to provide a simple, efficient, inexpensive and effective means for providing a postage stamp assemblage including an image bearing unit such as a photographic film unit for application to postage.

I claim:

1. An improved postage stamp assembly, comprising:

at least one indicia bearing element containing a photographic film unit, an overlay sheet having a bottom surface and an upper surface, positioned over said indicia bearing element, a pressure-sensitive adhesive layer affixed to said bottom surface, a transparent zone positioned within said overlay sheet such that said indicia bearing element is visible through said overlay sheet by means of said transparent zone, and a label portion affixed to said upper surface of said overlay sheet.

2. The improved postage stamp assembly of claim 1 wherein said upper surface of said overlay sheet is ink accepting.

3. The improved postage stamp assemblage of claim 1, further comprising machine-readable indicia positioned on said upper surface.

4. The improved postage stamp assembly of claim 1, further comprising postage indicia positioned on said upper surface.

5. An improved postage stamp assembly comprising:

at least one indicia bearing element containing a photographic film unit, an overlay sheet having a bottom surface and an upper surface, positioned over said indicia bearing element, a pressure-sensitive adhesive layer affixed to said bottom surface, a transparent zone positioned within said overlay sheet such that said indicia bearing element is visible through said overlay sheet by means of said transparent zone, wherein said transparent zone is die cut and in registration with said photographic film unit.

* * * * *